US006782570B1

(12) United States Patent
Bhatt

(10) Patent No.: US 6,782,570 B1
(45) Date of Patent: Aug. 31, 2004

(54) INTERWOVEN HAMMOCK BED

(75) Inventor: Dhananjay S. Bhatt, Channai (IN)

(73) Assignee: Hatteras Hammocks Inc., Greenville, NC (US)

( * ) Notice: Subject to any disclaimer, the term of this patent is extended or adjusted under 35 U.S.C. 154(b) by 17 days.

(21) Appl. No.: 10/358,699

(22) Filed: Feb. 6, 2003

(51) Int. Cl.[7] ..... A45F 3/22
(52) U.S. Cl. ..... 5/122; 5/120
(58) Field of Search ..... 5/120, 122, 124, 5/121, 123, 126, 128, 482, 500, 502

(56) References Cited

U.S. PATENT DOCUMENTS 799,763 A * 9/1905 Steiner ..... 5/502
1,479,903 A * 1/1924 Erlander ..... 294/142
2,596,547 A * 5/1952 Guest ..... 5/502
3,675,256 A * 7/1972 Tallarico et al. ..... 5/120
3,878,574 A * 4/1975 Erickson ..... 5/413 R
4,002,368 A * 1/1977 Ortize ..... 297/273
4,365,658 A * 12/1982 Stevens ..... 383/29
4,800,601 A * 1/1989 DeCaro ..... 5/123
4,989,656 A * 2/1991 Derfler ..... 150/108
5,033,135 A * 7/1991 Creek ..... 5/413 R
5,855,032 A * 1/1999 Field ..... 5/502
6,381,779 B1 * 5/2002 Thompson ..... 5/502

* cited by examiner

*Primary Examiner*—Teri Pham Luu
*Assistant Examiner*—Fredrick Conley
(74) *Attorney, Agent, or Firm*—J. W. Gipple; Gipple & Hale

(57) ABSTRACT

A hammock is described which has a bed surface of quilted strips contiguously interwoven into a surface that is soft and relatively smooth. Each strip comprises an interior fill layer of polyester fiber stitched in place between a top layer and bottom layer of weather resistant fabric.

1 Claim, 2 Drawing Sheets

INTERWOVEN HAMMOCK BED

FIELD OF THE INVENTION

This invention is directed to the body support surfaces of outdoor furniture, such as hammock beds, hammock pillows and rocker seats. The invention uses quilted fabric strips, interwoven in a basket weave pattern to create a soft and relatively smooth surface, which is flexible and porous.

BACKGROUND OF THE INVENTION

The original and classic hammock was essentially a sheet of canvas suspended between two supports. A stretched sheet of canvas has little capacity to flex; so lying on such a canvas hammock was as comfortable as lying on a sheet of plywood sagging towards the middle. Furthermore, canvas quickly deteriorates when subjected to outdoor conditions in which hammocks are most often used. The fibers quickly weaken and rips begin to occur.

Currently a popular alternative to the canvas hammock, is a hammock comprised of netting, which readily flexes to accommodate the shape of the person lying on it. The most common of such hammocks is formed of rope netting. Its surface comprises a network of ropes extending between two wooden spreader bars. The spreader bars help to maintain the rope network in an extended position thereby providing a more or less horizontal surface to support a body.

Rope hammocks remedy some shortcomings of canvas hammocks. They are readily flexible and made of polyester fibers which are weather resistant. However, a rope hammock by its nature is a network of ropes with substantial empty spaces between. The ropes do all of the supporting; the spaces between them provide the flexibility. Because the ropes do all of the supporting, and because they are rough and abrasive, there is often some discomfort to the user. The rough ropes dig into the bodies of the users, particularly those who are lightly clad.

It is, accordingly, an object of this invention to provide an improved hammock that has all of the advantages of a rope netting hammock, but also have a smooth and soft surface.

DISCLOSURE OF THE PRIOR ART

Applicant is aware of no prior art that directly relates to or anticipates this invention.

SUMMARY OF THE INVENTION

In accordance with the present invention, a hammock is provided that has a bed surface formed of quilted strips, contiguously interwoven into a supporting surface that is soft and relatively smooth. Each quilted strip comprises a top layer of weather resistant fabric, a bottom layer of the same fabric and interior fill layer of non-absorbent polyester fiber, and stitched together by a binding stitch to create a closed edge construction, joining top and bottom layers, while encasing the interior fill. The strips are interwoven in a basket weave, so that while they provide a more continuous surface than a rope net, there is still sufficient space between the strips to make the bed porous so that air can readily circulate.

DETAILED DESCRIPTION OF THE DRAWINGS

Reference will now be made in detail to the preferred embodiment of the invention illustrated in the accompanying drawings.

Figure 1:
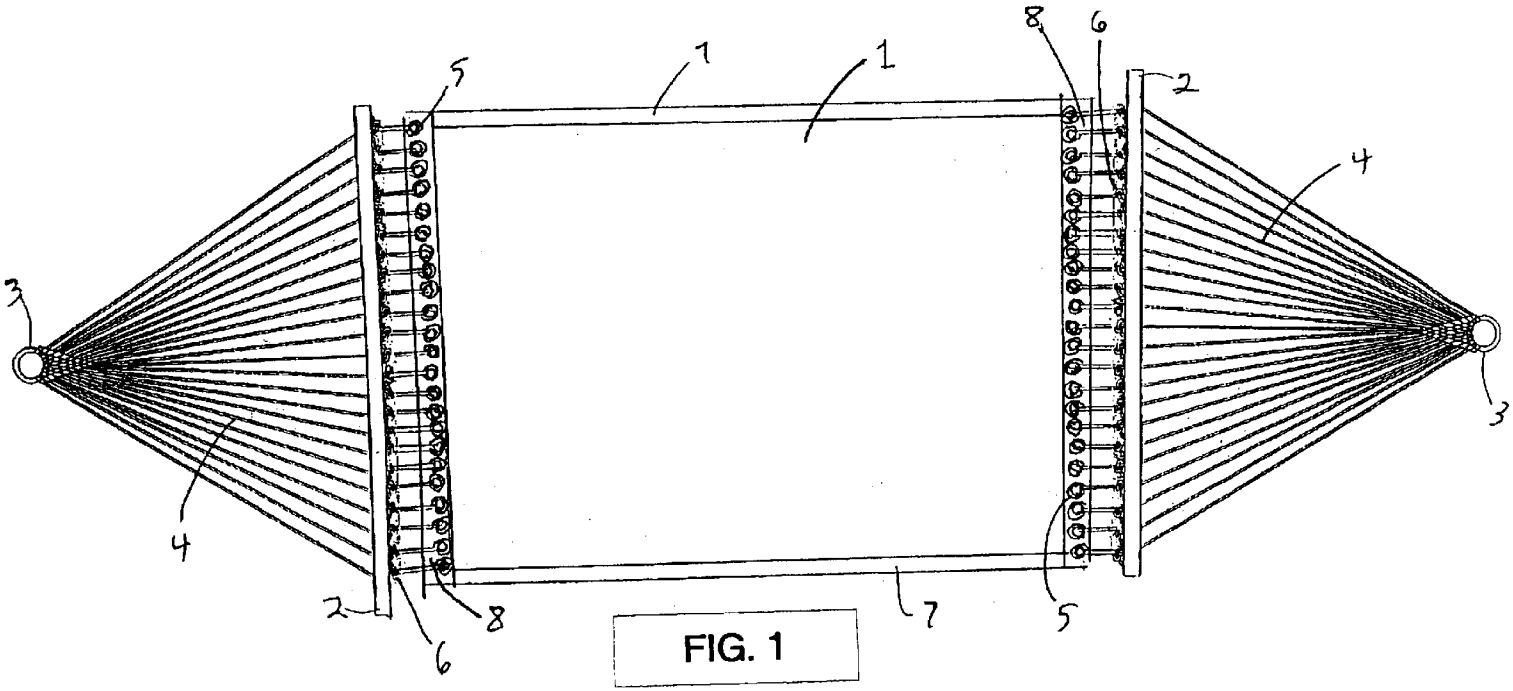
FIG. 1 is a top plan view of a hammock.

FIG. 1 illustrates a hammock, which includes a hammock bed 1, suspended between and supported by a rope clew 4 on each opposite end. The ropes which comprise each clew 4 are made of polyester yarns in three plies. The ropes which form each clew 4, extend from terminal support rings 3, through spaced apertures in spreader bars 2, loop through grommets 5, and back toward spreader bars 2, where their ends are tied in a bowline knot 6. The bowline knot 6 prevent slippage and maintain each clew 4 in a stable relation to the hammock bed 1. Grommets 5 are made of brass or brass tone steel. The spreader bars are solid oak with approximately 22 holes which are counter sunk on both ends to minimize abrasion of the clew ropes. The spreader bars 2 help to maintain the hammock bed 1 in an extended and relatively stable position.

Figure 2:
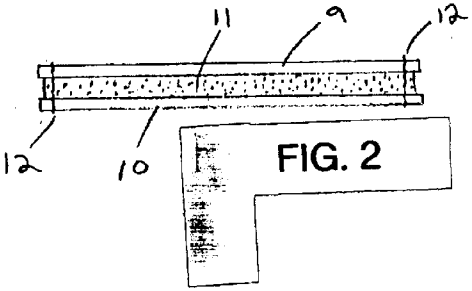
FIG. 2 is a cross sectional view of a quilted strap.
Figure 4:
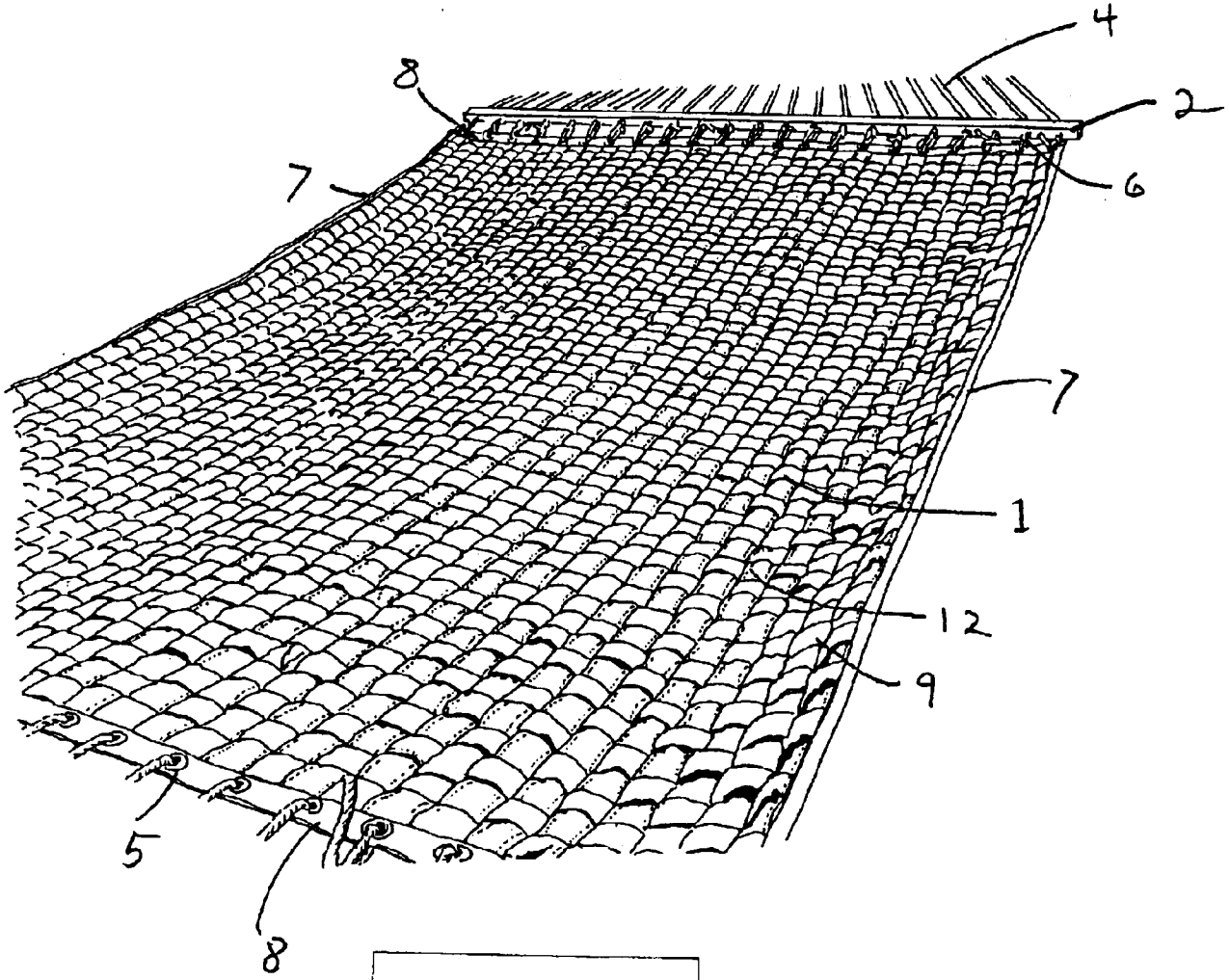
FIG. 4 is a perspective view showing the interweaving of quilted strips

The hammock bed 1 is comprised of interwoven quilted strips, the basket weave of which is illustrated in greater detail in FIG. 4. On the outer periphery of hammock bed 1, are side border strips 7 and end border strips 8. Each quilted strip, as illustrated in FIG. 2, includes a top layer of fabric 9 and a bottom layer 10 of the same fabric, which is of solution dyed olefin or acrylic fibers or poly-coated olefin or acrylic fibers. Between the top layer 9 and bottom layer 10, is an interior fill 11 formed of non-absorbent polyester fiber. It is lightweight, springy and weather resistant. A binding stitch 12 is employed on each side of the quilted strip to create a closed edge construction joining top layer 9 and bottom layer 10 while encasing interior fill 11.

Figure 3:
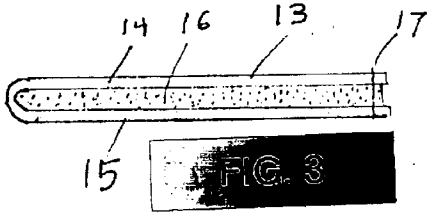
FIG. 3 is a cross sectional view of a border strip.

Border strips 7 and 8, are constructed in a manner similar to the quilted strip illustrated in FIG. 2. But, as illustrated in FIG. 3, the border strips 7 and 8, do not have a separated top layer 9 and bottom layer 10. Instead they have a single sheet 13, which is folded double to form a top side 14 and bottom side 15. Its interior fill 16 can be strengthening fiber or yarn, rather than a springy one, because on the border strength is more important than cushiony. The open end of the folded single sheet 13 is secured by binding stitch 17. It will be appreciated that this construction provides a side of the border strips 7 and 8, opposite the side secured by stitch 17, which is rounded and continuous. No filler 16 is exposed. This is desirable for the outer periphery of the hammock bed.

FIG. 4 illustrates the manner in which the quilted strips are interwoven in a basket weave pattern, and other aspects of the hammock described above.

What is claimed is:

1. The structure of a body supporting surface for outdoor furniture comprising a plurality of quilted strips interwoven to form a flexible, porous surface which is soft and relatively smooth wherein said plurality of quilted strips comprise a hammock bed or chair wherein said hammock or chair extends between and is fastened to side border strips and end border strips on its periphery wherein said quilted strips are secured by a binding stitch on each side.

* * * * *